US006377183B1

(12) United States Patent
Baker et al.

(10) Patent No.: US 6,377,183 B1
(45) Date of Patent: Apr. 23, 2002

(54) SMOKE DETECTOR HAVING A MOISTURE COMPENSATING DEVICE

(75) Inventors: Patrick T. Baker, Everett; Steven M. Barton, Edmonds; David C. Soreide, Seattle, all of WA (US); Russell W. Stark; James W. Tseng, both of Arcadia, CA (US)

(73) Assignee: The Boeing Company, Seattle, WA (US)

( * ) Notice: Subject to any disclaimer, the term of this patent is extended or adjusted under 35 U.S.C. 154(b) by 55 days.

(21) Appl. No.: 09/594,256

(22) Filed: Jun. 15, 2000

Related U.S. Application Data

(60) Provisional application No. 60/139,711, filed on Jun. 17, 1999.

(51) Int. Cl.[7] ..... G08B 17/10

(52) U.S. Cl. ..... 340/630; 340/628; 250/574; 356/338

(58) Field of Search ..... 340/628, 630; 356/338; 250/574

(56) References Cited

U.S. PATENT DOCUMENTS

| | | | | |
|---|---|---|---|---|
| 1,828,894 A | | 10/1931 | Freygang | |
| 3,312,826 A | | 4/1967 | Finkle | |
| 3,474,435 A | | 10/1969 | White et al. | |
| 3,710,365 A | | 1/1973 | Barnes | |
| 3,968,379 A | | 7/1976 | Crane | |
| 3,992,102 A | * | 11/1976 | Kajii | 340/630 |
| 4,166,960 A | | 9/1979 | Meili | |
| 4,315,158 A | | 2/1982 | Kakigi et al. | |
| 4,321,466 A | | 3/1982 | Mallory et al. | |
| 4,596,465 A | | 6/1986 | Nagashima | |
| 4,857,895 A | | 8/1989 | Kaprelian | |
| 4,870,394 A | | 9/1989 | Corl et al. | |
| 4,897,634 A | * | 1/1990 | Sawa et al. | 340/630 |
| 4,906,978 A | | 3/1990 | Best et al. | |
| 4,937,562 A | * | 6/1990 | Kaminaka et al. | 340/628 |
| 5,781,291 A | * | 7/1998 | So et al. | 340/630 |
| 6,057,774 A | * | 5/2000 | Venzant | 340/630 |

* cited by examiner

*Primary Examiner*—Daniel J. Wu
(74) *Attorney, Agent, or Firm*—Aston & Bird LLP

(57) ABSTRACT

A smoke detector that is insensitive to moisture, such as for use in aircraft cargo bays and the like, is provided. The smoke detector includes a housing defining a chamber that is sealed from outside light sources yet is capable of receiving smoke. The smoke detector also includes a light source that is positioned inside the chamber and a detector for receiving diffusely scattered light within the chamber. Advantageously, the smoke detector also includes a moisture compensating device that reflects a substantially consistent percentage of light incident thereupon regardless of moisture on the surfaces thereof such that the operation of the light source can be reliably tested even in environments where moisture has condensed or otherwise collected on the walls of the housing.

22 Claims, 3 Drawing Sheets

SMOKE DETECTOR HAVING A MOISTURE COMPENSATING DEVICE

CROSS-REFERENCE TO RELATED APPLICATIONS

This application claims priority from U.S. Provisional Application No. 60/139,711, filed Jun. 17, 1999, the contents of which are incorporated herein.

FIELD OF THE INVENTION

This invention relates to smoke detectors, and more particularly to smoke detectors capable of compensating for moisture.

BACKGROUND OF THE INVENTION

Smoke detectors are commonly used to detect the presence of smoke particles in the air by sensing light scattered from a light beam by smoke particles that infiltrate the smoke detector. In particular, the smoke detector typically includes a housing that defines a chamber that allows smoke to enter without allowing light to enter from the outside. A light source, such as a light emitting diode (LED), is disposed within the chamber for emitting light. A detector, such as a photoelectric eye or photodiode, is also disposed within the chamber. In the absence of smoke, most of the light emitted by the light source is typically absorbed by the chamber walls or some other light trap prior to reaching the detector. In this regard, the walls of the chamber are typically painted a dark color, such as flat black, in order to absorb most of the light incident thereupon. If smoke is present within the chamber, however, the light is scattered by the smoke particles, and a portion of the scattered light is received by the detector, which can cause an alarm if the incident light exceeds a predetermined limit that is indicative of an undesirable concentration of smoke.

In airplane applications, a test of the smoke detector, typically conducted by built-in-test equipment (BITE), must be made before each flight. These detectors typically use the diffusely scattered light from the walls of the chamber to test whether the system is working. In this way, maintenance personnel and/or flight crews can verify that both the light source and the scattered light detector are operational before a flight. Typically, the pre-flight check includes switching on the light source in the chamber and measuring the small level of light scattered from the walls of the chamber that is incident upon the detector. The detector must be sensitive to slight changes in the reflected light inside the chamber in order to detect smoke precisely. Thus, the detector is typically designed to signal a fault signal or an alarm if the reflected light received by the detector is above or below a predetermined range.

Unfortunately, conventional smoke detectors do not behave as expected in the presence of moisture within the chamber. In particular, the light otherwise scattered throughout the chamber by reflections from the walls is dramatically reduced if the walls of the chamber become wet, such as by condensation or humidity caused by the cargo or atmospheric changes. The cause of this behavior primarily lies in the composition of paint. More specifically, paint is typically composed of a clear or substantially clear medium and a pigment, which comprises a finely divided powder. On a close level, flat paint has a surface that is not smooth. Instead, the surface is composed of a large number of flat facets that are randomly oriented and which scatter incident light into a hemispherical pattern. The amount of scattered light from such a reflector is referred to as the Fresnel reflection and is roughly 4% at normal incidence from materials with an index of refraction of about 1.5, which is typical in conventional smoke detectors.

As known in the art, the intensity of Fresnel reflection is governed by the difference in the index of refraction across a particular surface. If the outer medium is air, the difference in the index of refraction is about 0.5. Because the index of refraction of a typical paint medium is roughly equal to that of water, very little light is scattered when the inner surface of the smoke detector is covered with water. Some light is reflected by the outer surface of the water, but this light is more directional and smaller than the light scattered from the paint surface.

Accordingly, when the walls of the chamber become wet, the above-described process results in essentially complete absorption of all light emitted from the light source. During testing of the smoke detector, therefore, the detector will fail to receive any diffusely scattered light from inside the chamber and will send an erroneous fault signal indicating that the light source is not operational.

Thus, there is a need for a smoke detector that is capable of performing and being reliably tested in the presence of moisture, such as when carrying high humidity cargo, i.e., animals, fruit, flowers, or the like. In addition, such a smoke detector should be easy to manufacture and capable of being retrofitted into existing smoke detector locations.

SUMMARY OF THE INVENTION

These and other needs are provided, according to the present invention, by a smoke detector having a moisture compensating device that reflects a substantially constant percentage of diffusely scattered light regardless of moisture present on the surfaces of the smoke detector. The moisture compensating device includes a moisture-insensitive light trap, which absorbs a large percentage of the light incident thereupon, whether the surface of the light trap is wet or dry. The moisture compensating device also includes a moisture-insensitive reflector, which reflects a predetermined percentage of the light incident thereupon regardless of moisture on the reflector. Accordingly, the smoke detector of the present invention can be reliably tested even in instances which moisture has collected on the inner surfaces of the smoke detector since the moisture compensating device will still reflect a constant percentage of light, thereby avoiding the fault indication provided by conventional smoke detectors when the inner surfaces of the smoke detector become wet and alter the reflectivity of the surfaces thereof.

In particular, the smoke detector of the present invention includes a housing defining at least one opening for receiving smoke. The housing, however, does not permit light to enter from external sources. Instead, a light source is positioned inside the housing for emitting a light beam across at least a portion of the housing. A photodetector, such as a photodiode, is also positioned inside the housing for receiving diffusely scattered light from inside the housing. According to one embodiment, the detector and associated circuitry send a fault signal if the level of diffusely scattered light sensed by the detector falls below a minimum value, thereby indicating that the light source is no longer operable.

Advantageously, the smoke detector of the present invention also includes a moisture compensating device within the housing that can be at least partially illuminated by the light source. The moisture compensating device includes a light trap that is insensitive to the presence of moisture. In one embodiment, the light trap comprises a folded sheet of light-absorbing material, although many alternative configurations may also be used. The moisture compensating device also includes a reflector. The reflector is capable of reflecting a substantially consistent percentage of the light incident thereupon regardless of moisture present on the surface of the reflector. In one embodiment, the reflector is coincident with and, in some instances, attached to the light trap. The reflector can have many shapes and configurations, including a metallic strip or wire extending across a portion of the inside of the housing or light trap such that the light emitted from the light source is at least partially incident upon the reflector.

Thus, the smoke detector of the present invention overcomes the difficulties encountered by conventional smoke detectors by providing a moisture compensating device that reflects a substantially consistent percentage of light incident thereupon regardless of moisture present on the surfaces thereof. In effect, the smoke detector of the present invention reflects substantially the same percentage of light as a conventional light trap does when dry, regardless of any moisture whatsoever on the surfaces of the light trap of the present invention. Thus, the smoke detector can be reliably tested to insure proper operation of the light source, even in high moisture conditions. In addition, the smoke detector of the present invention is easy to manufacture and can be retrofitted into existing smoke detector locations in aircraft cargo bays and the like.

BRIEF DESCRIPTION OF THE DRAWINGS

While some of the objects and advantages of the present invention have been stated, others will appear as the description proceeds when taken in conjunction with the accompanying drawings, which are not necessarily drawn to scale, wherein.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
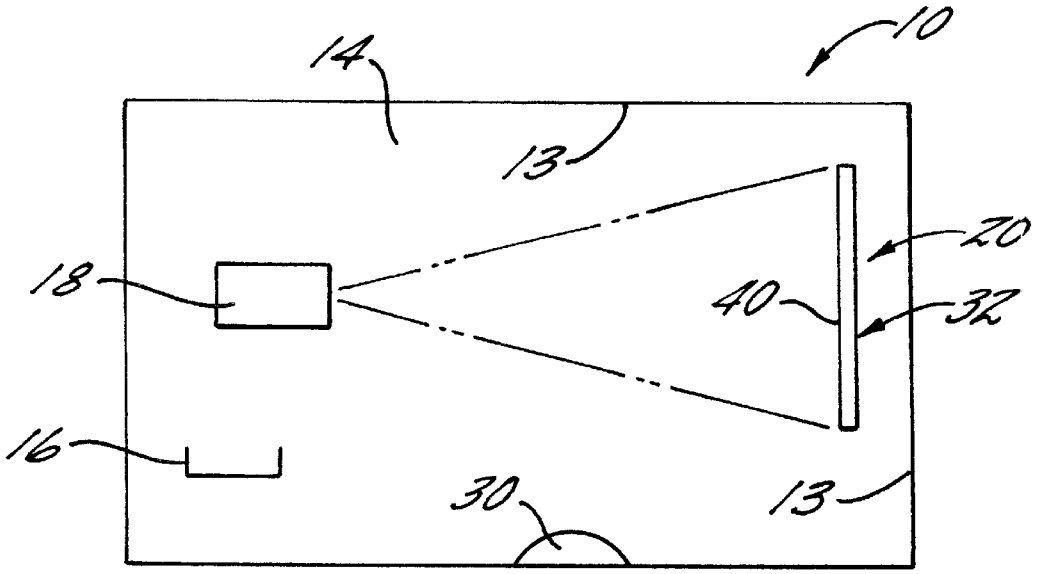
FIG. 1 is a schematic view of a smoke detector according to one embodiment of the present invention.

Turning first to FIG. 1, a smoke detector according to the present invention is generally designated as 10. The smoke detector 10 is particularly advantageous for use in an aircraft cargo bay, although other applications where moisture is present can also benefit from the smoke detector of the present invention. The smoke detector 10 includes a housing 12 that is formed by walls 13, the inner surfaces of which are painted or coated with a light-absorbing material, such as flat black paint. In one embodiment, the walls 13 are arranged in a box configuration to define a chamber 14 therein. At least one opening 16 is also defined by the housing 12 such that smoke can enter into the chamber 14. Otherwise, the housing 12 is sealed such that light from external sources is unable to enter the chamber 14.

A light source 18, such as a light emitting diode (LED), is located inside the housing 12, preferably near one end of the chamber 14. Other light sources can also be used that are known in the art, such as a laser or incandescent lamp, irrespective of wavelength used for the light source 18. The light or radiation emitted by the light source 18 is directed toward a moisture compensating device (MCD) that is in a spaced relationship with the light source 18 within the housing 12 of the smoke detector 10. The MCD 20 reflects a substantially consistent percentage of light incident thereupon regardless of moisture present on the surfaces thereof, as discussed more fully below.

The smoke detector 10 also includes a detector 30 positioned inside the housing 12 for receiving diffusely scattered light from inside the housing. In one embodiment, the detector 30 is a photodetector, such as a photodiode, although other types of detectors, such as photoconductive or photoresistive detectors, can also be used. The detector 30 can be positioned proximate the MCD 20. As shown in FIG. 1, the detector 30 is positioned to one side of the MCD 20. The detector 30 can have other positions, however, as long as the detector is capable of receiving the diffusely scattered light that is reflected by the MCD 20.

It has been determined experimentally that water, accumulating on the walls 13 at which the light is targeted, "traps" the light that is normally scattered off the walls. This phenomena was observed by slowly covering a dot of light from the light source 18 on one wall 13 with a water drop using an eye dropper. Successively larger drops of water were placed on the wall 13 illuminated by the dot of light. Light scattered from the wall was observed to lose intensity as the water drops covered more of the area illuminated by the light. When the illuminated area was completely covered with water, the scattered light glow within the chamber 14 was practically extinguished. Thus, in a test of a conventional smoke detector in a moist environment, the detector might erroneously signal that the light source is inoperable since the light is being trapped by the moisture and is not being reflected to the detector.

Advantageously, the MCD 20 reflects a substantially consistent and predetermined percentage of light regardless of moisture present on the surfaces thereof. In particular, the MCD 20 includes a moisture-insensitive light trap 32 that reflects a predetermined percentage of light incident thereupon no matter if the light trap is wet or dry. Preferably, the predetermined percentage of light reflected by the light trap 32 is substantially zero. In this regard, the light trap 32 includes a surface 34 that is shaped for absorbing substantially all of the light incident thereupon. In addition, the surface 34 of the light trap 32 has a light absorbing color, such as flat black, that reflects a minimum percentage of light. As a result of its construction, the light trap 32 reflects the same percentage of light incident thereupon whether wet or dry. This is particularly advantageous when carrying high humidity cargo such as boxes of fruit, flowers, animals, or the like.

The MCD 20 also includes a moisture-insensitive reflector 40. Like the light trap 32, the reflector 40 reflects a substantially constant percentage of light incident thereupon regardless of the moisture present on the surface thereof, as discussed more fully below. As such, the reflector 40 is primarily, if not fully, responsible for directing light to the detector 30. In this regard, the reflector 40 has a shiny or reflective color, such as silver or other color lighter than the walls 13 of the chamber 14, which causes light to be reflected and diffused within the chamber such that the diffused light is received by the detector 30.

Figure 2:
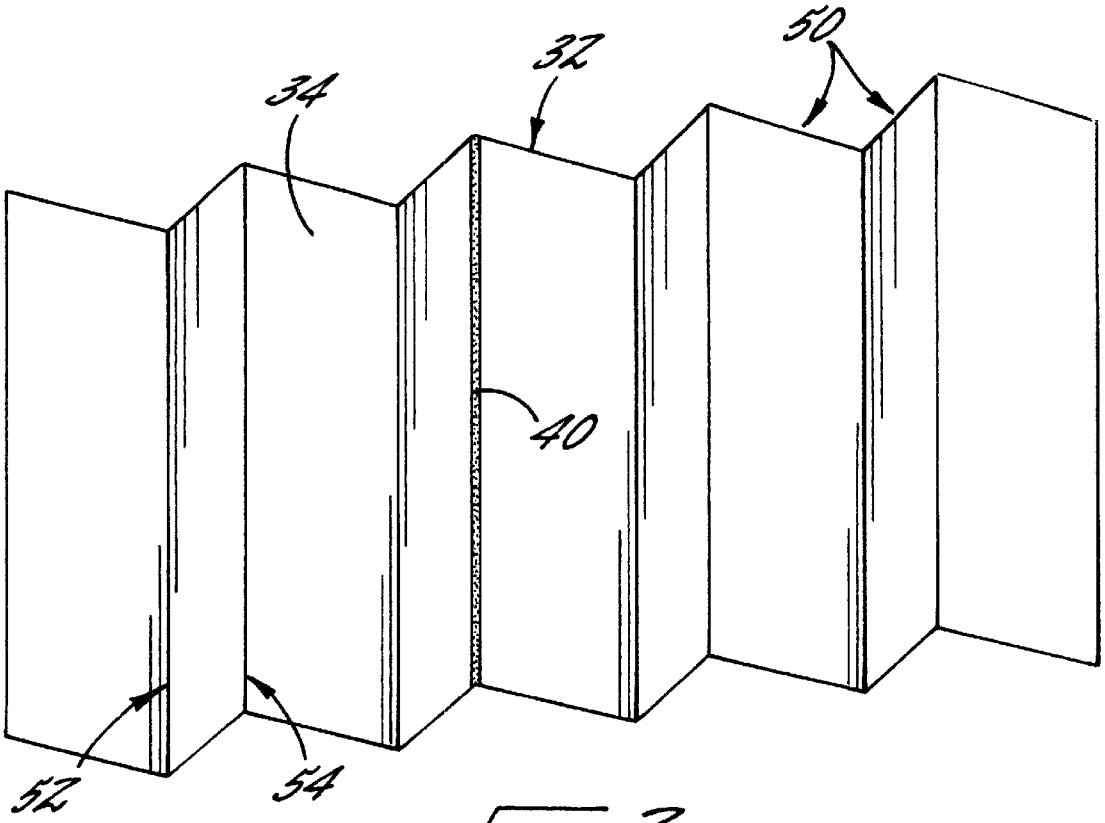
FIG. 2 is a perspective views of a moisture compensating device according to one embodiment of the present invention.

Turning to FIGS. 2–7, the MCD 20 of various embodiments is shown in more detail. In particular, FIG. 2 shows one embodiment of the MCD 20 wherein the light trap 32 is in the shape of a folded sheet resembling a series of parallel "V" surfaces. In one embodiment, the folded sheet includes 7–8 folds, wherein the MCD 20 has the outer dimensions after folding of 1.5×1.5 inches. The number of folds, however, is a function of the area required for the particular MCD. In addition, the "V" surfaces define an acute angle therebetween, which in one embodiment is approximately 45 degrees. Although other acute angles may also be used, the light trap 32 loses effectiveness when the acute angle approaches 90 degrees.

FIG. 2 shows a particularly advantageous embodiment of the reflector 40, wherein the reflector is in the form of a reflective strip or wire, such as an uncoated stainless steel wire, extending across a portion of the light trap 32. Other materials could also be used, such as an aluminum foil tape or even a glossy-type paint that provides similar reflective properties as the strip or wire. In operation, light emitted from the light source 18 is directed to the MCD 20, whereby the light is incident upon the angled surfaces 50 of the light trap 32 and the reflector 40. Regardless of whether the light trap is wet or dry, the light incident upon the angled surfaces 50 of the light trap 32 is reflected or directed further into the remainder of the light trap 32 such that substantially zero light is reflected back into the chamber 14 by the light trap. Thus, the light trap 32 can be wet or dry with no appreciable difference in reflectance. The light incident upon the reflector 40, however, is reflected at least partially into the chamber 14 regardless of whether the reflector is wet or dry, which enables the detector 30 to verify operation of the light source 18.

Figure 3:
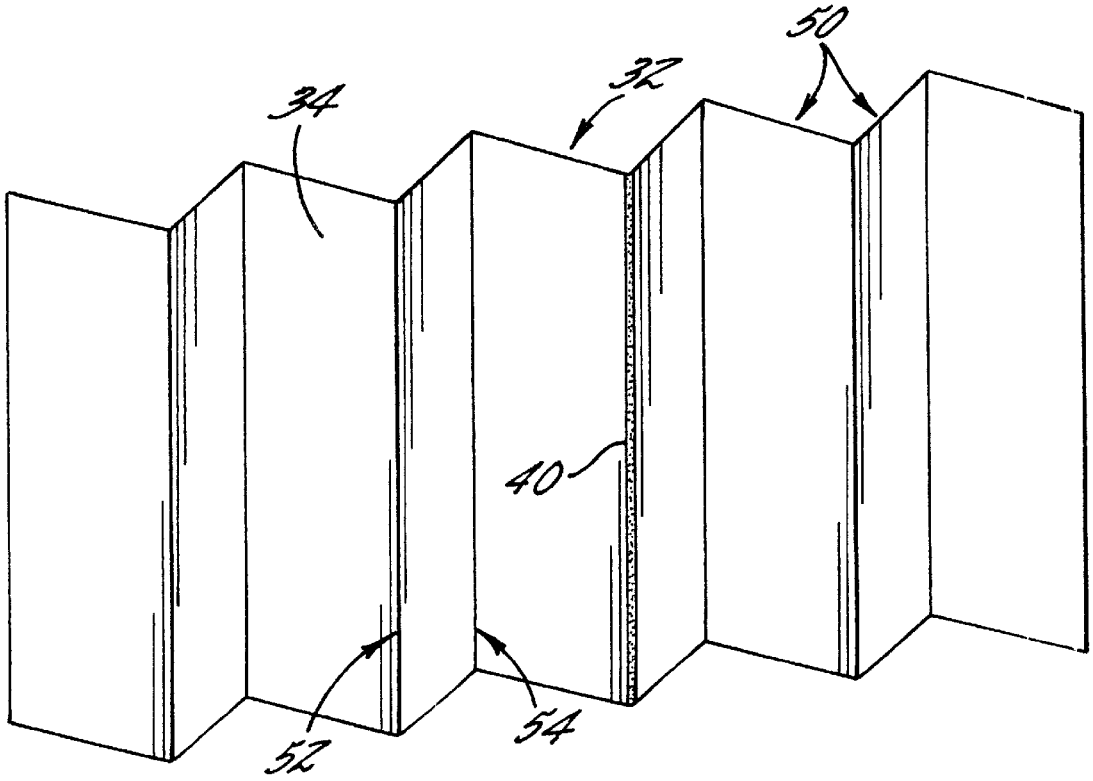
FIGS. 3–6 are perspective views of a moisture compensating device according to alternative embodiments of the present invention.
Figure 4:
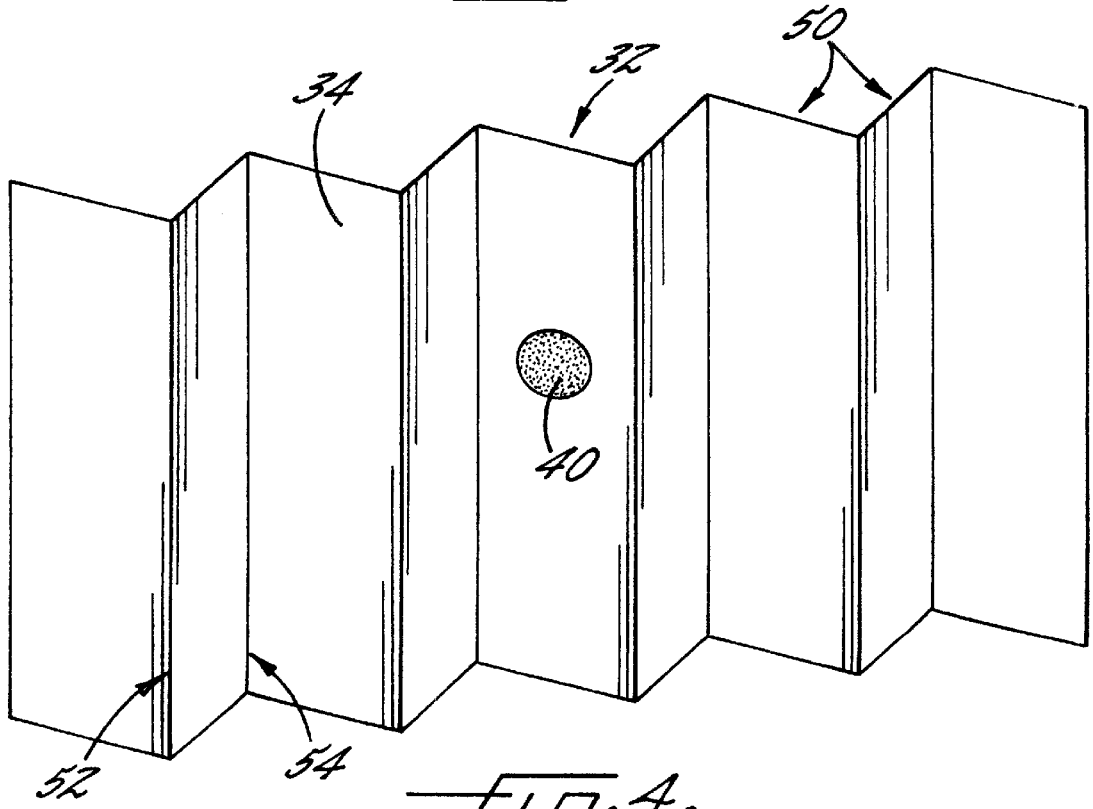
Figure 5:
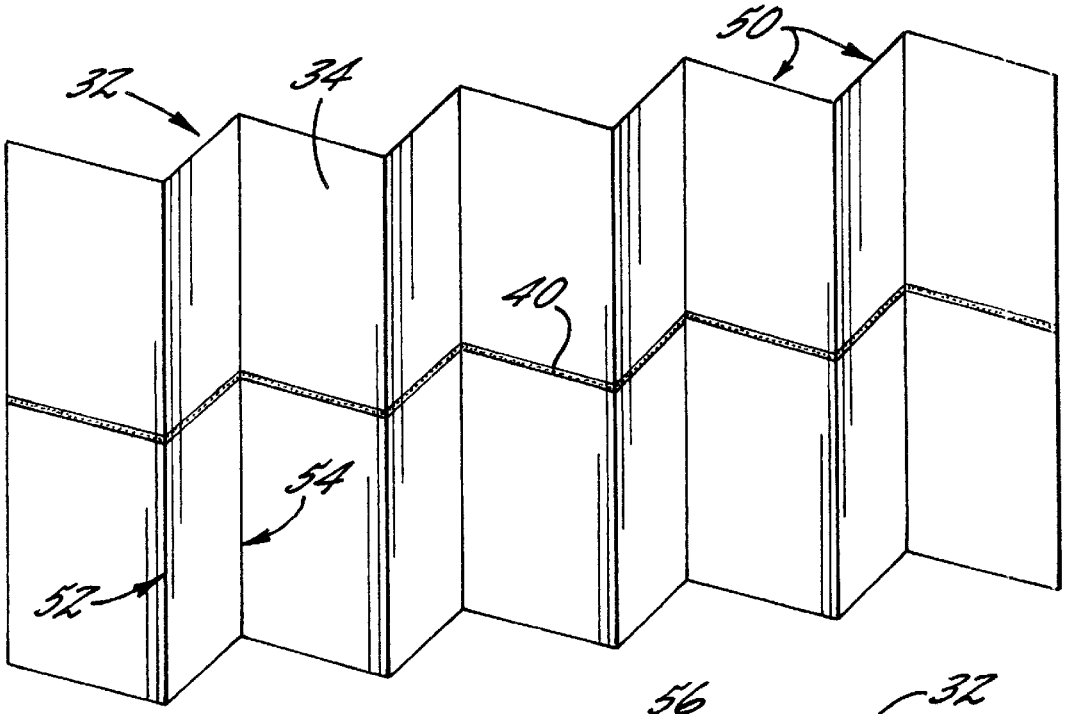

FIGS. 3–7 show alternative embodiments of the MCD 20. In particular, FIG. 3 shows one alternative embodiment wherein the reflector 40 is disposed along a distal end 52 of the light trap 32, which is defined as the "trough" or "valley" between the parallel "V" surfaces of the light trap, whereas FIG. 2 shows the reflector disposed along a proximal end 54 of the light trap 32, which is defined as the "peak" formed by the parallel "V" surfaces of the light trap. FIG. 4 shows another alternative embodiment of the MCD 20 wherein the reflector 40 is in the shape of a circle or other geometric shape and is disposed upon the angled surfaces 50 of the light trap 32. FIG. 5 shows yet another alternative embodiment of the MCD 20 wherein the reflector 40 extends along the angled surfaces 50 of the light trap 32 from one side of the light trap to the other.

Figure 6:
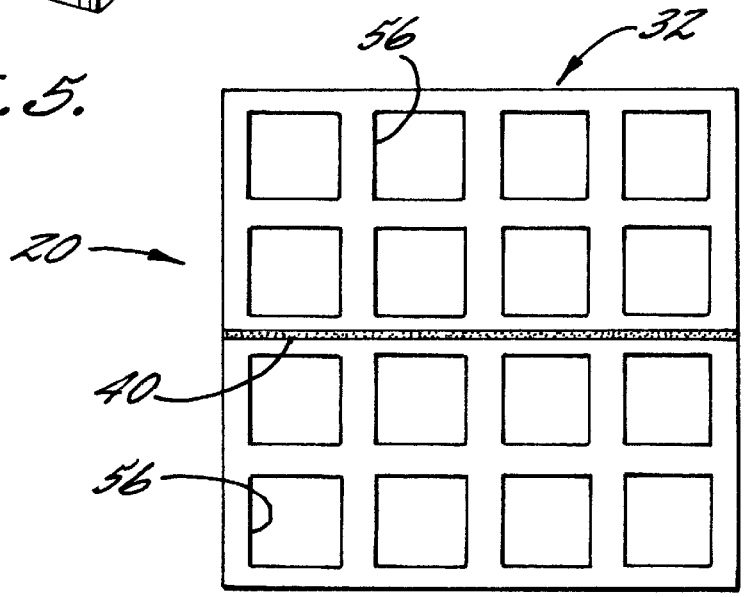

FIG. 6 shows yet another embodiment of the MCD 20 according to the present invention wherein the light trap 32 has a generally planar surface and defines a plurality of holes 56 extending therethrough through which a majority of the light emitted from the light source 18 passes. According to this embodiment, the light passing through the holes 56 is trapped behind the MCD 20 and is absorbed by the MCD and the walls of the chamber. In addition, the reflector 40 is positioned on the surface 34 of the light trap 32 and reflects a substantially constant percentage of light incident thereupon regardless of moisture, as discussed above. Although shown as a strip of material, the reflector 40 can also have other dimensions, such as a dot of material and like, as long as it reflects a substantially constant percentage of light as discuss above.

Figure 7:
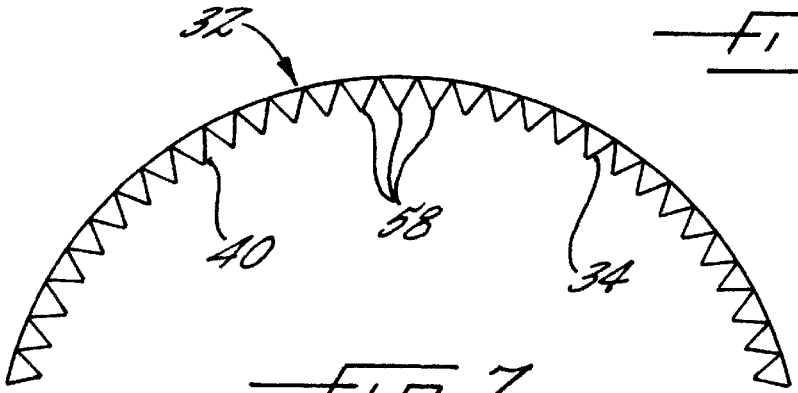
FIG. 7 is an end view of a moisture compensating device according to yet another alternative embodiment of the present invention.

FIG. 7 shows yet another alternative embodiment of the MCD 20 according to the present invention wherein the surface 34 of the light trap 32 has a curved, concave shape that absorbs substantially all of the light incident thereupon. According to this embodiment, the surface 34 includes a series of ridges or projections 58 that act to reflect light from one projection to another until virtually all light incident upon the surface 34 is absorbed. The reflector 40 is positioned along the surface 34 of the light trap 32, and, in particular, is positioned upon one of the projections 58 such that light incident upon the reflector 40 is reflected back into the chamber 14 and received by the detector 30.

As shown in FIGS. 2–7, the reflector 40 can be coincident with the light trap 32, and in particular the reflector can be attached to or painted upon the light trap. However, the reflector can have other locations within the chamber 14 without departing from the spirit and scope of the invention. For example, the reflector 40 can be positioned proximate yet separate from the light trap 32 such that light emitted from the light source 18 is separately incident upon both the reflector and the light trap. In yet another alternate embodiment, the reflector 40 is a reflective section of the wall located to one side of the light trap.

Many modifications and other embodiments of the invention will come to mind to one skilled in the art to which this invention pertains having the benefit of the teachings presented in the foregoing descriptions and the associated drawings. For example, the housing can have many other shapes and configurations, thus enabling the smoke detector to be used in other applications, whether moisture may be present or not. Further, the MCD can also have many other shapes and sizes, and is not intended to be limited to the embodiments shown in the attached figures. In this regard, the light trap of the present invention preferably reflects substantially no light. Thus, any shape of light trap that accomplishes this function is intended to be within the scope of the present invention. Likewise, the reflector can have many shapes or configurations so long as the reflector reflects a substantially constant percentage of light irrespective of whether it is wet or dry. Therefore, it is to be understood that the invention is not to be limited to the specific embodiments disclosed and that modifications and other embodiments are intended to be included within the scope of the appended claims. Moreover, the present invention is not intended to be limited to smoke detectors, as other types of optical devices utilizing the teachings of the present invention are meant to be within the scope thereof. Although specific terms are employed herein, they are used in a generic and descriptive sense only and not for purposes of limitation.

What is claimed is:

1. A smoke detector capable of operation in the presence of moisture, comprising:

a housing defining at least one opening for receiving smoke;

a light source positioned inside said housing;

a detector positioned inside said housing for receiving diffusely scattered light from inside said housing; and a moisture compensating device within said housing that is illuminated by said light source, said moisture compensating device including a moisture-insensitive light trap and a moisture-insensitive reflector, said light trap and reflector each having a surface that reflects a substantially consistent percentage of light regardless of moisture present on the surfaces thereof.

2. A smoke detector according to claim 1, wherein said light trap reflects substantially no light incident thereupon regardless of moisture present upon said light trap.

3. A smoke detector according to claim 1, wherein said reflector reflects a predetermined percentage of light incident thereupon, said percentage being greater than zero, regardless of moisture present upon said reflector.

4. A smoke detector according to claim 1, wherein said moisture-insensitive light trap comprises a folded sheet of light-absorbing material.

5. A smoke detector according to claim 1, wherein said moisture-insensitive light trap comprises a generally planar surface defining a plurality of holes through which light passes.

6. A smoke detector according to claim 1, wherein said moisture-insensitive light trap comprises a generally curved surface having a plurality of angled surfaces thereupon for absorbing substantially all light incident upon said light trap.

7. A smoke detector according to claim 1, wherein said reflector is coincident with said light trap.

8. A smoke detector according to claim 7, wherein said reflector is attached to said light trap.

9. A smoke detector according to claim 1, wherein said reflector is a metallic strip.

10. A smoke detector according to claim 1, wherein said moisture compensating device is spaced apart from and has a direct optical path to said light source.

11. A moisture compensating device for a smoke detector, comprising:

a light trap that absorbs light within the smoke detector that is incident thereupon, the absorbance of said light being reduced insubstantially when said light trap becomes wet; and a reflector arranged to reflect at least a portion of the light within the smoke detector that is incident thereupon, the portion of light reflected by the reflector being reduced insubstantially when the reflector becomes wet.

12. A moisture compensating device according to claim 11, wherein said light trap reflects substantially no light incident thereupon regardless of moisture present upon said light trap.

13. A moisture compensating device according to claim 11, wherein said light trap comprises a folded sheet of light-absorbing material.

14. A moisture compensating device according to claim 11, wherein said light trap comprises a generally planar surface defining a plurality of holes through which light passes.

15. A moisture compensating device according to claim 11, wherein said reflector is coincident with said light trap.

16. A moisture compensating device according to claim 15, wherein said reflector is attached to said light trap.

17. A moisture compensating device according to claim 11, wherein said reflector is a metallic strip.

18. A method of testing a smoke detector, comprising:

directing light from a source toward a moisture-insensitive surface;

reflecting a substantially consistent percentage of light from the moisture-insensitive surface regardless of the presence of moisture on the surface; and detecting the reflected light to verify operation of the light source.

19. A method according to claim 18, further comprising activating a fault signal when the detected light is below a predetermined level.

20. A method according to claim 18, wherein said detecting step occurs before the presence of smoke.

21. A method according to claim 18, wherein said reflecting step occurs when the moisture-insensitive surface is wet.

22. A method according to claim 18, further comprising emitting a predetermined response when the detected light level is within a predetermined range.

* * * * *